US005994995A

United States Patent [19]

Ogasawara et al.

[11] Patent Number: 5,994,995

[45] Date of Patent: Nov. 30, 1999

[54] LAMINATED CHIP VARISTOR AND PRODUCTION METHOD THEREOF

[75] Inventors: Tadashi Ogasawara; Kaneo Mori; Masaaki Taniguchi; Masahiko Konno, all of Akita, Japan; Dai Matsuoka, Arlington, Mass.

[73] Assignee: TDK Corporation, Tokyo, Japan

[21] Appl. No.: 09/017,229

[22] Filed: Feb. 2, 1998

[30] Foreign Application Priority Data

Feb. 3, 1997 [JP] Japan ..... 9-020426

[51] Int. Cl.[6] ..... H01C 1/148

[52] U.S. Cl. ..... 338/21; 338/274; 338/308; 338/332; 257/536; 29/610.1

[58] Field of Search ..... 338/21, 332, 308, 338/274; 257/536, 537; 438/43; 29/610.1; 204/192.2

[56] References Cited

U.S. PATENT DOCUMENTS 5,339,068 8/1994 Tsunoda et al. .

FOREIGN PATENT DOCUMENTS 4-280616 10/1992 Japan .
5-326215 12/1993 Japan .
6-112085 4/1994 Japan .

*Primary Examiner*—Donald L. Monin, Jr.
*Attorney, Agent, or Firm*—Oblon, Spivak, McClelland, Maier & Neustadt, P.C.

[57] ABSTRACT

A laminated chip varistor has a varistor element including at least one varistor layer and at least two inner electrodes which are laminated alternatively, and outer most layers comprising the same material as the varistor layer; and terminal electrodes electrically connected to the inner electrodes each formed at each of the both edge portions of the varistor element; wherein a surface roughness (R) of the varistor element is in the range of 0.60 to 0.90 $\mu$m.

14 Claims, 1 Drawing Sheet

LAMINATED CHIP VARISTOR AND PRODUCTION METHOD THEREOF

BACKGROUND OF THE INVENTION

1. Field of the Invention

The present invention relates to a varistor and, in particular, to a laminated chip varistor capable of applying uniform soldering onto terminal electrodes only of the laminated chip varistor and to a production method thereof.

2. Description of the Related Art

Recently, electronic equipments has been miniaturized. For example, in electric parts driven by a small voltage such as IC, it is necessary to protect them from abnormal voltage, and a chip-type varistor has been generally used.

For chip parts, silver is used as the terminal electrodes. However, because the silver electrode is eroded by solder, nickel plating, etc., is applied onto the silver outer electrode to solder it. Also, in order to improve the soldering property, tin or tin-lead plating is further applied onto the nickel plating, etc.

A varistor layer constituting the laminated chip varistor is mainly composed of ZnO. Because ZnO is a semiconductor, when above-described nickel plating and tin or tin-lead plating is carried out by electrolytic plating, the ceramic portions of the varistor layer is also plated.

In order to prevent this, a high-resisting layer is formed on the surface of a ceramic element, which becomes a chip-type varistor, by dipping a glass composed of an oxide of Si, B, Bi, Pb, Ca, etc., or a high-resisting layer is formed by placing a mixture mainly composed of oxides of Si, Fe, Al, Ti, Sb on the surface of the ceramic element followed by burning (see, Unexamined Japanese Patent Publications (kokai) Hei-8-31616, Hei-8-124720, and Hei-8-153607).

However, in the glass coating and the surface treatment process with the oxide as described above, the work is complicated and further there is a problem that lowering of the yield occurs by attaching the glass or the surface oxide to portions other than the necessary portions, which results in increasing the cost.

Also, it has been found that when an unevenness exists on the surface of the above-described ceramic element, an electric field is liable to be concentrated to the projected portions and these portions are plated to spread undesirable plating to the surrounding surface of the element. Accordingly, it becomes necessary to remove the unevenness of the surface of the element to form the flat surface, thereby the occurrence of the undesirable flow of plating is prevented.

SUMMARY OF THE INVENTION

It is an object of the present invention to provide at a low cost a laminated chip varistor capable of making uniform plating at plating on the outer electrodes.

A laminated chip varistor of the present invention comprising a varistor element in which at least one varistor layer and at least two inner electrodes are alternately laminated, the varistor element having outermost layers made up of the same material as that of the varistor layer, and terminal electrodes electrically connected to the inner electrodes each formed at each of both edge portions of the varistor element, wherein a surface roughness (R) of the varistor element is formed to be from 0.60 to 0.90 $\mu$m.

By making the surface roughness (R) of the varistor element from 0.60 to 0.90 $\mu$m as described above, when the 2nd electrode and the 3rd electrode are formed by electrolytically plating each of the terminal electrodes, the occurrence of the concentration of an electric field to the projected portions at the electrolytic plating of the terminal electrode is prevented and a uniform plated film can be formed on the terminal electrode only without the flowing out of plating. Furthermore, the problem that electroplating in the terminal electrode becomes impossible occurring in the case of more reducing the unevenness can be overcome.

PREFERRED EMBODIMENTS OF THE INVENTION

Preferred embodiments of the present invention will be described as follows with reference to the accompanying drawings.

Figure 1:
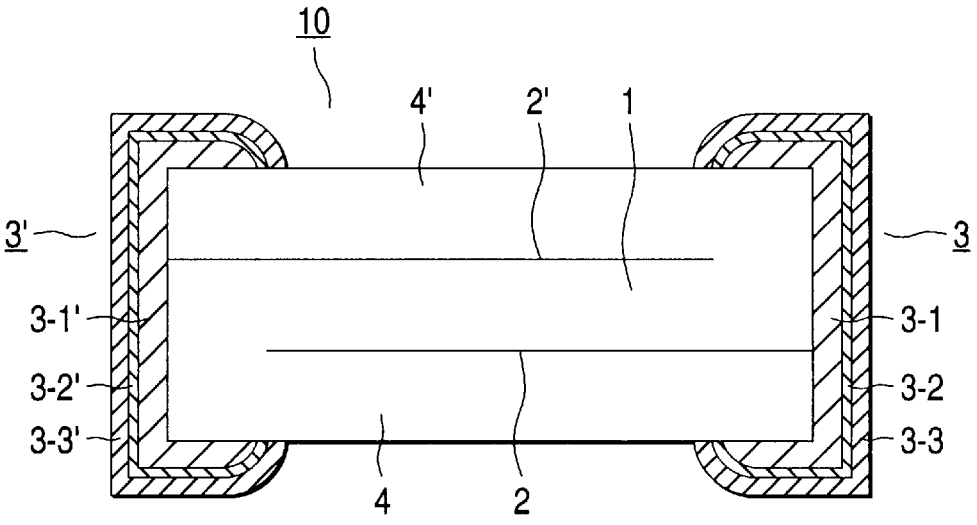
FIG. 1 is a sectional view showing a first embodiment of the present invention.

A first embodiment of the present invention is explained in detail based on FIG. 1. FIG. 1 is a sectional view showing the inside structure of the laminated chip varistor of the present invention. In FIG. 1, reference numeral 1 represents a varistor layer; 2, 2', inner electrodes; 3, 3', terminal electrodes; 3-1, 3-1', 1st electrodes; 3-2, 3-2', Ni films; 3-3, 3-3', Sn films; 4, 4'; protective layers; and 10, varistor element.

The varistor layer 1 is mainly composed of zinc oxide (ZnO) as will be described below. Inner electrodes 2, 2' connected to the terminal electrodes 3, 3' different from each other are formed at the terminal portions thereof. In addition, the inner electrodes 2, 2' are formed by printing a palladium paste and baking simultaneously with the varistor element.

The terminal electrode 3 is composed of the 1st electrode 3-1 formed by baking a silver paste, the Ni layer 3-2 is electrolytically plated for preventing the 1st electrode 3-1 from being eroded by a soft solder, and the Sn layer 3-3 is electrolytically plated for improving the soldering property.

The terminal electrode 3' is composed of the 1st electrode 3-1', the Ni layer 3-2', and the Sn layer 3-3' as in the terminal electrode 3.

Also, protective layers 4, 4' composed of the same material as the varistor layer 1 are formed as the outermost layers respectively.

Further, the surfaces of the varistor element 10 are constituted so that the surface roughness becomes the range of from 0.60 to 0.90 $\mu$m by the reason described below.

Figure 2:
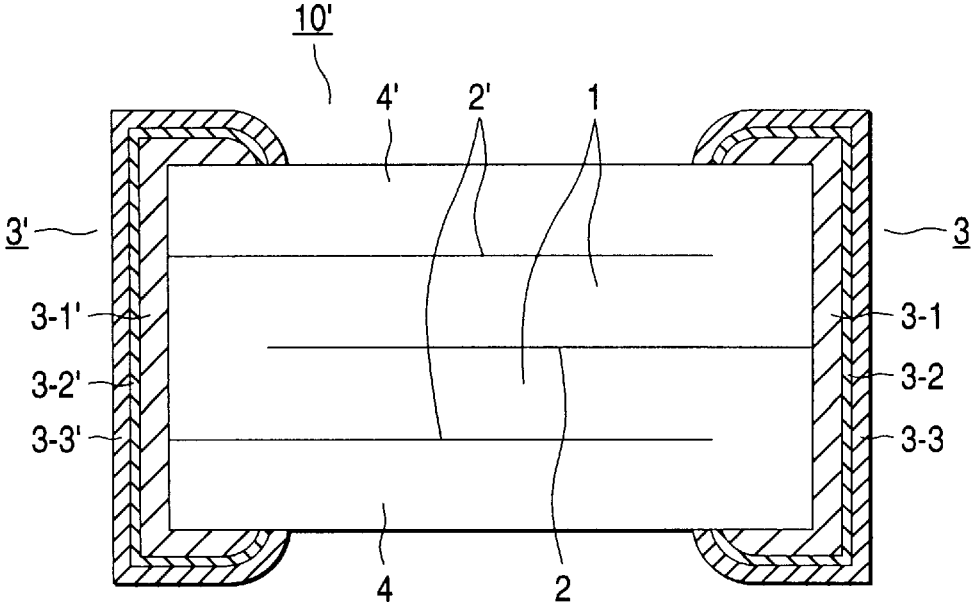
FIG. 2 is a sectional view showing a second embodiment of the present invention.

A second embodiment of the present invention is explained referring to FIG. 2.

Although FIG. 1 shows the embodiment equipped with one varistor layer 1, FIG. 2 shows an embodiment equipped with two varistor layers 1, 1. Terminal electrodes 3, 3' and protective layers 4, 4' are constituted same as the first embodiment as shown in FIG. 1. Accordingly, a varistor element 10' has two varistor layers 1, 1, three inner electrodes 2, 2', 2', two protective layers 4, 4'.

In the present invention, the number of the varistor layer 1 is not limited to those shown in FIG. 1 and FIG. 2 but can be properly selected according to the use thereof.

Then, one embodiment of the production method of the laminated chip varistor of the present invention is explained.

First, to constitute the varistor layer 1, starting material of the varistor layer 1 was prepared so that they became the ratio of 1.2 wt. % cobalt oxide (CoO), 0.5 wt. % praseodymium oxide ($Pr_6O_{11}$), 0.1 wt. % calcium carbonate ($CaCO_3$), and 0.03 wt. % silicon oxide ($SiO_2$) to 98.17 wt. % oxide (ZnO) as a main component.

To the powder mixture of the starting materials were added an organic binder (acrylic binder), an organic solvent (Toluol aceton ethyl acetato), and an organic plasticizer (diethyl phthalate, dibutyl phthalate or dioctyl phthalate), and then mixed and ground by a ball mill for 20 hours to prepare a slurry.

Using the slurry, a green sheet having a thickness of 30 μm was formed on a base film made of PET (polyethylene terephthalate) by a doctor blade method. Then, the green sheet was released from the base film and cut into a definite form.

Plural green sheets cut therefrom were laminated to form a protective layer 4 and thereafter, a varistor layer 1 and inner electrodes 2, 2' were laminated. In this case, as the material of the inner electrodes 2, 2', a palladium paste was used, the paste was printed by a screen printing to obtain a desired form. After drying, the varistor layer 1 was laminated thereon. After laminating desired number of varistor layers and the desired form of the electrodes, a protective layer 4' was laminated to produce a varistor element 10 (10'). After heating and press-sticking the varistor element, it was cut into a definite form to provide a green chip.

After removing a binder from the green chip under the condition of 350° C. for 2 hours, the green chip was burned in air at 1250° C. for 2 hours to obtain a sintered material.

Then, the sintered material was placed in a centrifugal barrel, then polishing media such as ceramic balls and glass balls, an abrasive such as a grindstone powder, and water were placed in the barrel, and they were stirred together to polish the sintered material for 30 minutes, 1 hour, 2 hours, 4 hours, and 7 hours respectively.

Also, when the surface roughness of the varistor element of each sintered material thus polished by stirring for each time was measured by a surface roughness meter, the surface roughness (R) of each element after barrel polishing was as follows.

1.18 μm (30 minutes)

0.90 μm (1 hour)

0.76 μm (2 hours)

0.60 μm (4 hours)

0.53 μm (7 hours)

In addition, the surface roughness of the varistor element of the sintered material which was not subjected to the barrel polishing was 3.20 μm. Also, as the surface roughness meter, Surfcom 570 A manufactured by Kabushiki Kaisha Tokyo Seimitsu was used. Also, each of these numeral values was the average value of 10 samples.

Then, an electrode paste made up of silver as a main component was coated on both the edge portions of each of the varistor element which was not barrel polished described above, the varistor element barrel-polished for 30 minutes, the varistor element barrel-polished for 1 hour, the varistor element barrel-polished for 2 hours, the varistor element barrel-polished for 2 hours, the varistor element barrel-polished for 4 hours, and the varistor element barrel-polished for 7 hours followed by baking at 800° C. to form 1st electrodes 3-1, 3-1'.

Also, an electrolytic Ni plating was applied to the surface of each of the 1st electrodes 3-1, 3-1' at an electric current of 2 A for 30 minutes to form Ni films 3-2, 3-2' which were 2nd electrodes, and further an electrolytic Sn plating was applied thereon at an electric current of 0.6 A for 30 minutes to form Sn films 3-3, 3-3' which were 3rd electrodes.

In addition, Ni plating is for preventing Ag from being eroded by a solder and Sn plating is for improving the soldering property. In addition, Sn-Pb may be used in place of Sn.

From the section of the varistor obtained as described above, it was found that the thickness of the Ni films 3-2, 3-2' formed by each electrolytic plating was 1.0 μm and the thickness of the Sn film 3-3, 3-3' was 2.5 μm. These numerical values were the average values of 10 samples respectively.

Then, the results determined these plated states are shown in Table 1. The Table 1 shows the examples of 1000 samples.

TABLE 1

| Sample No. | Barrel Polishing Condition Polishing Time | Surface Roughness (μm) | Inferior Ratio of Plating Flow (%) |
|---|---|---|---|
| 1 | No | 3.20 | 100 |
| 2 | 30 minutes | 1.18 | 68 |
| 3 | 60 minutes | 0.90 | 0 |
| 4 | 120 minutes | 0.76 | 0 |
| 5 | 240 minutes | 0.60 | 0 |
| 6 | 420 minutes | 0.53 | Plating impossible |

(Note): The plating flow means that plating is applied on the surface.

In Table 1, Sample No. 1 is the case that barrel polishing is not applied and the surface roughness (R) of the varistor element is 3.2 μm. In Sample No. 1, an electric field was concentrated to the projected portions owing to the large roughness, electrolytic plating was applied from the portions and the plating flow by which plating was applied to undesirable surface of the varistor element other than the surrounding of the 1st electrode occurred on all the samples.

Sample No. 2 is the case that the barrel polishing time is 30 minutes and the surface roughness is 1.18 μm. Because the surface roughness was smaller than Sample No. 1, the occurrence of the plating flow was improved a little but even in this case, about 68% of the samples, the inferiority by the plating flow occurred.

Sample No. 3 is the case that the barrel polishing time is 1 hour and the surface roughness of the surface of the varistor element is 0.90 μm. 2 The surface roughness was less than Sample No. 1 and Sample No. 2 and the inferior ratio by the plating flow was 0.

Sample No. 4 is the case that the barrel polishing time is 2 hours and the surface roughness of the surface of the varistor element is 0.76 μm. The inferior ratio by the plating flow was 0.

Sample No. 5 is the case that the barrel polishing time is 4 hours and the surface roughness of the surface of the varistor element is 0.60 μm. The inferior ratio by the plating flow was 0.

Sample No. 6 is the case that the barrel polishing time is 7 hours and the surface roughness of the surface of the varistor element is 0.53 μm. The adhesion of the 1st electrodes 3-1, 3-1' coated with the electrode paste made up of Ag as a main component was bad, during the formation of the Ni films 3-2, 3-2' by electrolytic plating, the 1st electrodes 3-1, 3-1' were stripped off from the varistor element and the normal Ni films 3-2, 3-2' and Sn films 3-3, 3-3' could not be formed.

Accordingly, to make the plating flow 0%, it is necessary that the surface roughness of the varistor element is from 0.60 to 0.90 μm. In addition, in these surface roughnesses, the range of from 0.76 to 0.90 μm is short in the barrel polishing time and is more preferred in the production efficiency.

According to the present invention, by making the surface roughness of the element of a laminated chip varistor from 0.60 to 0.90 μm, a low-cost and high-reliability laminated chip varistor giving no plating flow at electroplating and having a good yield can be provided.

Also, because a 1st terminal electrode made up of silver as a main component is constituted by baking and a 2nd electrode of a material such as Ni for preventing silver from being eroded with a soft solder and a 3rd electrode such as Sn or Sn-Pb for improving the soldering property are formed thereon by electroplating, even when a soft solder is used, the 1st terminal electrode is not eroded with the soft solder, and the terminal electrode having a good soldering property can be constituted.

Furthermore, by polishing the sintered material of a laminated chip varistor by a centrifugal barrel, the surface roughness thereof can be formed from 0.60 to 0.90 μm by a very simple method and a low-cost and high-reliability laminated chip varistor giving no plating steam at electroplating and having a good yield can be produced.

What is claimed is:

1. A laminated chip varistor comprising:

a varistor element comprising at least one varistor layer and at least two inner electrodes which are laminated alternatively, and outer most layers comprising the same material as said varistor layer; and terminal electrodes electrically connected to said inner electrodes each formed at each of the both edge portions of said varistor element;

wherein a surface roughness (R) of said varistor element is in the range of 0.60 to 0.90 μm.

2. A laminated chip varistor according to claim 1, wherein said terminal electrode comprises:

a first terminal electrode comprising silver formed by baking and electrically connected to said inner electrodes;

a second electrode on said first terminal electrode for preventing said first terminal electrode from being eroded by a solder; and a third electrode for improving a soldering property formed on said second eletrode, said second and third electrode being formed by electroplating.

3. A laminated chip varistor according to claim 2, wherein said second electrode comprises Ni.

4. A laminated chip varistor according to claim 2, wherein said third electrode comprises Sn.

5. A laminated chip varistor according to claim 1, wherein a surface roughness (R) of said varistor element is in the range of 0.76 to 0.90 μm.

6. A laminated chip varistor according to claim 5, wherein a surface roughness of said edge portions of said varistor element on which said terminal electrodes are formed have said surface roughness in the range of 0.76 to 0.90 μm.

7. A laminated chip varistor according to claim 1, wherein said varistor layer comprises ZnO.

8. A laminated chip varistor according to claim 1, wherein said inner electrode comprises palladium.

9. A laminated chip varistor according to claim 1, wherein a surface roughness of said edge portions of said varistor element on which said terminal electrodes are formed have said surface roughness in the range of 0.60 to 0.90 μm.

10. A laminated chip varistor according to claim 1, wherein:

said varistor element comprises a material composed primarily of zinc oxide;

said edge portions of said varistor element comprise said material composed primarily of zinc oxide;

said terminal electrodes are disposed on said material of said edge portions; and wherein said edge portions each have a surface roughness in the range of 0.60 to 0.90 μm.

11. A laminated chip varistor as recited in claim 10, comprising:

said surface roughness of said edge portions being in the range of 0.76 to 0.90 μm.

12. A method of producing a laminated chip varistor, comprising the steps of:

forming a sintered material of a laminated chip varistor in which at least one varistor layer and at least two inner electrodes are laminated alternatively;

polishing the sintered material so that a surface roughness of the sintered material is in the range of 0.60 to 0.90 μm.

13. A method according to claim 12, wherein the sintered material of the above-described chip varistor is polished with a centrifugal barrel containing polishing media, an adhesive, and water.

14. A method according to claim 12, wherein the sintered material is polished so that the surface roughness of the sintered material is in the range of 0.76 to 0.90 μm.

* * * * *